US007025736B1

(12) United States Patent
Lawrence

(10) Patent No.: US 7,025,736 B1
(45) Date of Patent: Apr. 11, 2006

(54) MASSAGING SYSTEM

(76) Inventor: Lisa W. Lawrence, 3745 E. Oak St., Phoenix, AZ (US) 85008

( * ) Notice: Subject to any disclaimer, the term of this patent is extended or adjusted under 35 U.S.C. 154(b) by 33 days.

(21) Appl. No.: 10/723,689

(22) Filed: Nov. 26, 2003

Related U.S. Application Data

(60) Provisional application No. 60/430,028, filed on Nov. 29, 2002.

(51) Int. Cl.
*A61H 23/02* (2006.01)

(52) U.S. Cl. ..... 601/108; 601/107; 403/385; 403/389; 403/177

(58) Field of Classification Search ..... 601/46, 601/48, 57, 59, 97, 98, 99, 101, 103, 107, 601/108, 111, 133; 482/130, 142; 403/373, 403/389, 396, 177, 205, 385; 248/229.2, 248/229.23, 229.24, 227.3
See application file for complete search history.

(56) References Cited

U.S. PATENT DOCUMENTS

| | | | | |
|---|---|---|---|---|
| 2,621,968 | A * | 12/1952 | Vickroy | 248/229.24 |
| 3,865,310 | A * | 2/1975 | Elkins et al. | 248/229.1 |
| 4,946,122 | A * | 8/1990 | Ramsey et al. | 248/229.2 |
| 5,716,332 | A | 2/1998 | Noble | |
| 5,848,980 | A * | 12/1998 | Demerais | 601/133 |
| 5,951,501 | A * | 9/1999 | Griner | 601/108 |
| 6,309,135 | B1 * | 10/2001 | Thomson et al. | 403/373 |
| 6,346,088 | B1 * | 2/2002 | Stone et al. | 601/99 |

* cited by examiner

*Primary Examiner*—Quang D. Thanh
(74) *Attorney, Agent, or Firm*—Merchant & Gould P.C.

(57) ABSTRACT

A massage system providing a bracket for rigidly holding an electric or percussion massager, for example, a handheld massager, and a bracket height adjustment such that the massager may be utilized by a user at a specific height. The massage system provides rigid support for the massager to enable a person to back into the massager thereby more easily controlling the massage by him or herself without requiring use of the hands. The unit is wall mounted or door hung using a vertical bar and clamping holder. A programmable, motor operated unit is also disclosed.

12 Claims, 4 Drawing Sheets

MASSAGING SYSTEM

CROSS-REFERENCE TO RELATED APPLICATIONS

This application claims the benefit of U.S. Provisional Application Ser. No. 60/430,028, filed Nov. 29, 2002.

FIELD OF THE INVENTION

The present invention relates to massaging systems and to portable massagers.

BACKGROUND OF THE INVENTION

Typically, individuals using a hand-held electrically powered percussive massager have a difficult time applying the device to their back, unless receiving help from another person. Heretofore, persons utilizing a handheld electrically powered percussive massager for back massage would often have to put themselves in awkward positions to massage their back. Persons experiencing physical difficulty or arthritis, for example, would have even more difficulty.

SUMMARY OF THE INVENTION

A primary object and feature of the present invention is to provide a massage system for "no hands" individual self-massage.

It is a further object and feature of the present invention to provide such a system that utilizes a handheld electrically powered percussive massager.

It is a further object and feature of the present invention to provide such a system that provides a height adjustment for a massager at a specific height.

It is a further object and feature of the present invention to provide such a system that provides a motorized height adjustment.

It is a further object and feature of the present invention to provide such a system comprising a remote control.

It is a further object and feature of the present invention to provide such a system comprising a programmable remote control.

A further primary object and feature of the present invention is to provide such a system that is efficient, inexpensive, and handy. Other objects and features of this invention will become apparent with reference to the following descriptions.

In accordance with a preferred embodiment hereof, this invention provides a massage system for electrically powered percussive massage, comprising: hand holdable massaging means for electrically powered percussive massaging; and rigid holding means for rigidly holding such hand holdable massaging means; wherein such rigid holding means comprises removable holding means for removably holding such hand holdable massaging means. Moreover, it provides such a massage system further comprising fixed mounting means for fixedly mounting such rigid holding means. Additionally, it provides such a massage system further comprising doortop mounting means for mounting such rigid holding means hung from a doortop. Also, it provides such a massage system wherein such rigid holding means further comprises adjustable longitudinal setting means, comprising a rigid bar having a longitudinal length, for setting a user selected position, along such longitudinal length, for such hand holdable massaging means.

In accordance with another preferred embodiment hereof, this invention provides a massage system for electrically powered percussive massage, comprising: at least one hand holdable massager structured and arranged to provide electrically powered percussive massaging; and at least one rigid holder structured and arranged to rigidly hold such at least one hand holdable massager; wherein such at least one rigid holder is structured and arranged to removably hold such at least one hand holdable massager. In addition, it provides such a massage system further comprising at least one mount structured and arranged to fixedly mount such at least one rigid holder. And it provides such a massage system further comprising at least one doortop mount structured and arranged to mount such at least one rigid holder hung from at least one doortop. Further, it provides such a massage system wherein such at least one rigid holder further comprises at least one adjustable longitudinal position setter, comprising at least one rigid bar having a longitudinal length, structured and arranged to set at least one user selected position along such longitudinal length for such at least one hand holdable massager.

Even further, it provides such a massage system wherein such least one mount is fixedly mounted to a vertical surface. Moreover, it provides such a massage system wherein such at least one adjustable longitudinal position setter further comprises at least one clamp assembly structured and arranged to adjustably engage such at least one adjustable longitudinal position setter. Additionally, it provides such a massage system wherein such at least one clamp assembly comprises at least one first clamp structured and arranged to clamp and firmly retain such at least one hand holdable massager. Also, it provides such a massage system wherein: such at least one first clamp comprises at least one first substantially circular aperture structured and arranged to receive at least one portion of such one at least one hand holdable massager; and an inside diameter of such at least one first substantially circular aperture is adjustable.

In addition, it provides such a massage system wherein such at least one clamp assembly further comprises at least one second clamp structured and arranged to receive at lease one portion of such at least one adjustable longitudinal position setter. And it provides such a massage system wherein: such at least one second clamp comprises at least one second substantially circular aperture structured and arranged to receive at least one portion of such one at least one adjustable longitudinal position setter; and an inside diameter of such at least one second substantially circular aperture is adjustable. Further, it provides such a massage system wherein such at least one clamp assembly further comprises at least one electrically powered motor actuator structured and arranged to permit motorized travel along such longitudinal length. Even further, it provides such a massage system wherein such at least one electrically powered motor actuator comprises at least one control system structured and arranged to permit user control of the motorized travel along such longitudinal length. Even further, it provides such a massage system wherein such at least one control system is structured and arranged implement a program of user-desired settings. Even further, it provides such a massage system wherein such at least one electrically powered motor actuator comprises at least one electrical plug connector structured and arranged to permit plug in of at least one plug of such at least one hand holdable massager.

In accordance with another preferred embodiment hereof, this invention provides a kit system for implementing electrically powered, rigidly held percussive massage using at least one hand holdable massager, comprising: at least one rigid holder structured and arranged to rigidly hold the at least one hand holdable massager; wherein such at least one rigid holder structured and arranged to removably hold such at least one hand holdable massager; and wherein such at least one rigid holder further comprises at least one adjustable longitudinal position setter, comprising at least one rigid bar having a longitudinal length, structured and arranged to set at least one user selected position along such longitudinal length for the at least one hand holdable massager. Even further, it provides such a kit system further comprising indicia indicating: at least one group of massagers sized and arranged to be rigidly held by the at least one rigid holder; and instructions for assembly of the kit system where the user supplies the massager. Even further, it provides such a kit system further comprising at least one electrically powered motor actuator structured and arranged to permit motorized travel along such longitudinal length. Even further, it provides such a kit system further comprising indicia indicating: at least one group of massagers sized and arranged to be rigidly held by the at least one rigid holder; and instructions for assembly of the kit system where the user supplies the massager.

Additionally, this invention provides each and every novel feature, element, combination, step and/or method disclosed or suggested by this provisional patent application.

BRIEF DESCRIPTION OF THE DRAWINGS

Referring to the drawings.

DETAILED DESCRIPTION OF A PREFERRED EMBODIMENT

This invention relates to providing a massage system. More specifically, a massage system providing a bracket for rigidly holding an electrically powered percussion massager, for example, a hand held electric massager, and a bracket height adjustment such that the massager may be utilized by a user at a specific height. Furthermore, the massage system provides rigid support for the massager to enable a person to back into the massagers thereby more easily controlling the massage by themselves without requiring use of the hands.

Figure 1:
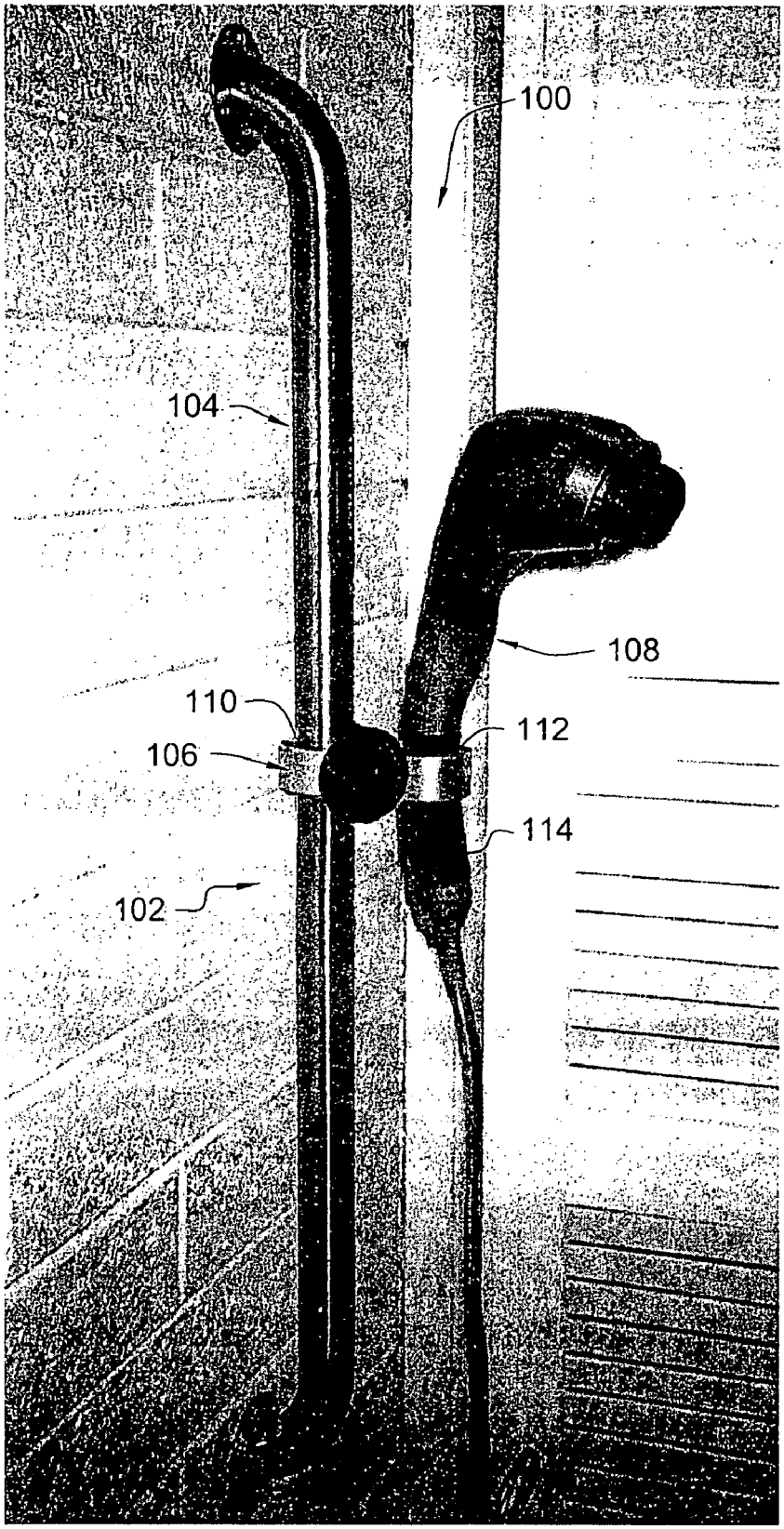
FIG. 1 is a photographic view of a wall mount massage assembly of the massage system according to a preferred embodiment of the present invention.
Figure 2:
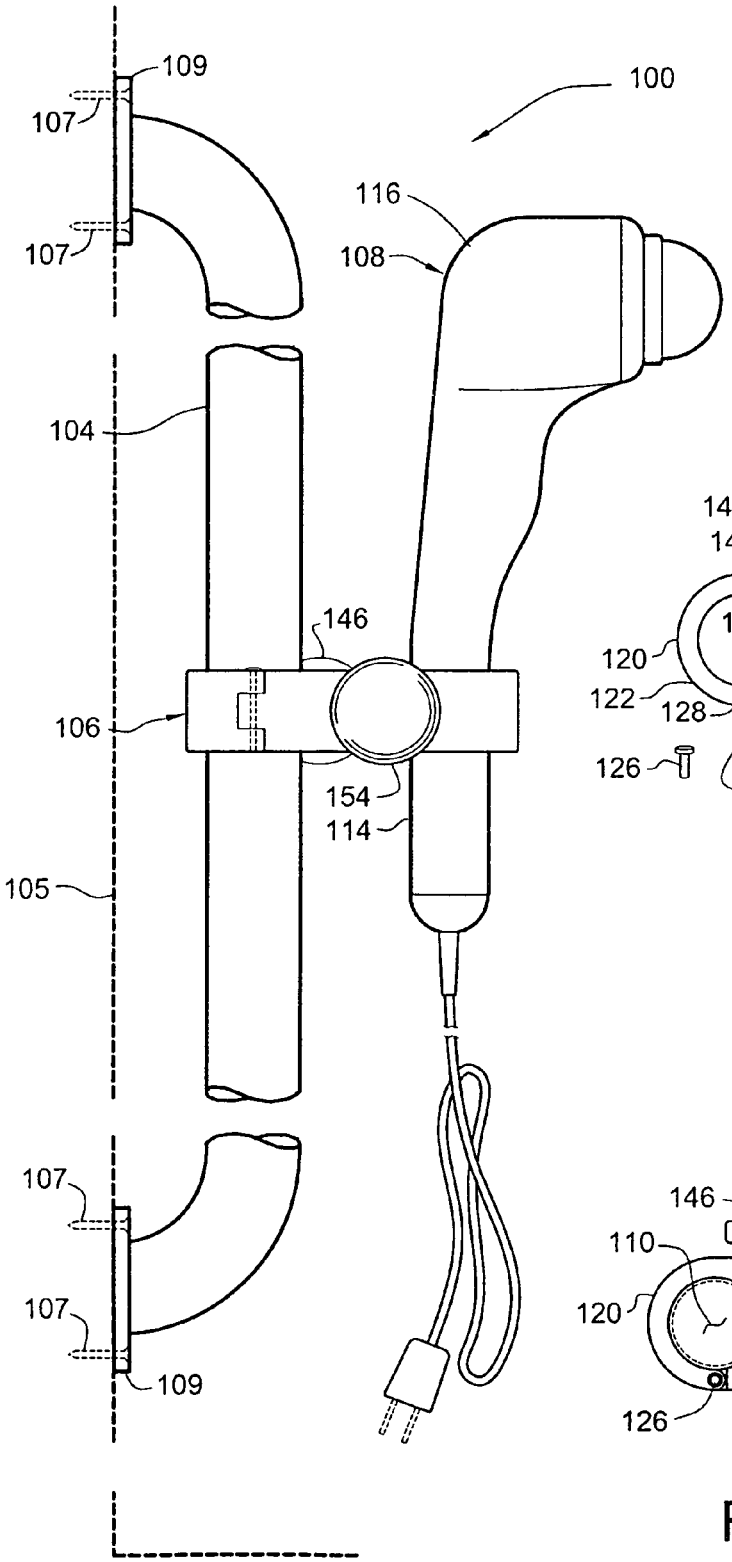
FIG. 2 is a side view, partially in section, of the wall mount massage assembly of FIG. 1.
Figure 3:
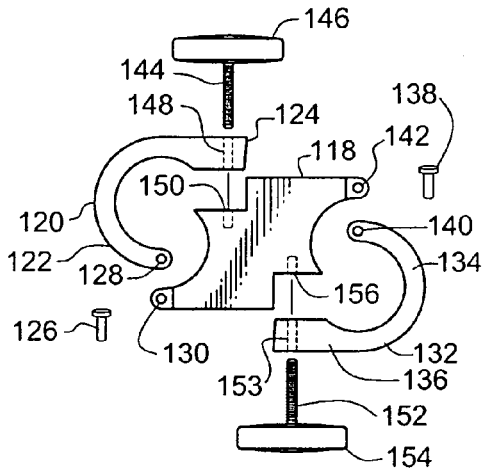
FIG. 3 is an exploded top view of a holding bracket of the massage system according to a preferred embodiment of the present invention.
Figure 4:
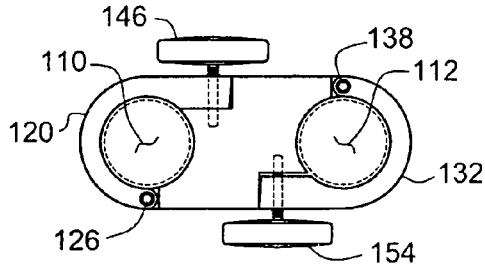
FIG. 4 is an assembled top view of the holding bracket of FIG. 3.

Reference is now made to the drawings. Specifically reference is now made to FIG. 1 through FIG. 4. FIG. 1 is a photographic view of a wall mount massage assembly 102 of the massage system 100 according to a preferred embodiment of the present invention. FIG. 2 is a side view, partially in section, of the wall mount massage assembly 102 of FIG. 1. FIG. 3 is an exploded top view of a holding bracket 106 of the massage system 100 according to a preferred embodiment of the present invention FIG. 4 is an assembled top view of the holding bracket 106 of FIG. 3.

Preferably, the wall mount massage assembly 102 comprises a bar 104, a holding bracket 106, and an electrically powered percussive massager 108, as shown. Preferably, bar 104 comprises a round hollow rod, preferably, stainless steel, preferably, one and one-half inch diameter, preferably, at least a thirty six inch long bar. In a highly preferred embodiment, a seventy two inch long bar is utilized. Preferably, bar 104 (embodying herein adjustable longitudinal setting means, comprising a rigid bar having a longitudinal length, for setting a user selected position, along such longitudinal length, for such hand holdable massaging means and further embodying herein at least one adjustable longitudinal position setter, comprising at least one rigid bar having a longitudinal length, structured and arranged to set at least one user selected position along such longitudinal length for such at least one hand holdable massager) is similar in construction to the stainless steel grab bars produced by Franklin Brass Co. of Carson, Calif. Under appropriate circumstances, other dimensions and materials may suffice to accommodate such factors as alternate preferred ranges of adjustability and cost. Preferably, mounting flange 109 is used to rigidly fasten bar 104 to wall 105 using appropriate fasteners 107, as shown (the above arrangement embodies herein, fixed mounting means for fixedly mounting such rigid holding means and further embodying herein at least one mount structured and arranged to fixedly mount such at least one rigid holder).

Holding bracket 106 (embodying herein rigid holding means for rigidly holding such hand holdable massaging means and further embodying herein at least one rigid holder structured and arranged to rigidly hold such at least one hand holdable massager) preferably comprises two apertures 110 and 112, as shown. Preferably, aperture 110 (embodying herein at least one second substantially circular aperture structured and arranged to receive at least one portion of such one at least one adjustable longitudinal position setter) has a diameter that will encircle and clamp to bar 106, as shown. Preferably, aperture 112 (embodying herein at least one first substantially circular aperture structured and arranged to receive at least one portion of such one at least one hand-holdable massager) has a diameter that will encircle a portion of the electrically powered percussive massager 108, preferably the handle 114 of a hand held massager 116, as shown. Preferably, holding bracket 106 comprises a center portion 118, a second clamping portion 120 and a first clamping portion 132, as shown.

Preferably, second clamping portion 120 (embodying herein at least one second clamp structured and arranged to receive at lease one portion of such at least one adjustable longitudinal position setter) comprises two ends 122 and 124, as shown. Preferably, end 122 permanently attaches to the center portion 118 utilizing a pin 126 placed into an aperture 128 in the second clamping portion 120 and an aligned aperture 130 in the center portion 118 such that the second clamping portion 120 can swing away from the center portion 118, as shown. Preferably, first clamping portion 132 (embodying herein at least one first clamp structured and arranged to clamp and firmly retain such at least one hand holdable massager) comprises two ends 134 and 136, as shown. Preferably, end 134 permanently attaches to the center portion 118 utilizing a pin 138 placed into an aperture 140 in the first clamping portion 132 and an aligned aperture 142 in the center portion 118 such that the first clamping portion 132 can swing away from the center portion 118, as shown. Preferably, the end 124 removably attaches to the center portion 118, as shown. Preferably, end 124 is attached to center portion 118 utilizing a threaded bolt 144, as shown. Preferably, the threaded bolt 144 comprises a knob 146 for turning the threaded bolt 144. Preferably, the threaded bolt 144 is inserted through an aperture 148 in the end 124 and into a threaded aperture 150 in the center portion 118, as shown.

Preferably, end 136 is attached to center portion 118 utilizing a threaded bolt 152, as shown. Preferably, the threaded bolt 144 comprises a knob 154 for turning the threaded bolt 152. Preferably, the threaded bolt 152 is inserted through an aperture 153 in the end 136 and into a threaded aperture 156 in the center portion 118, as shown. Under appropriate circumstances, other arrangements may suffice.

Figure 5:
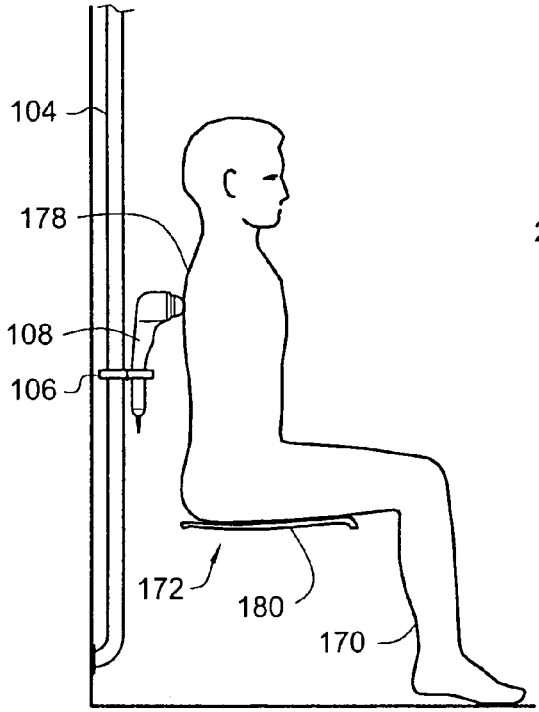
FIG. 5 is a side view of the wall mount massage assembly of FIG. 1 in use by an individual in a sitting position according to a preferred embodiment of the present invention.
Figure 6:
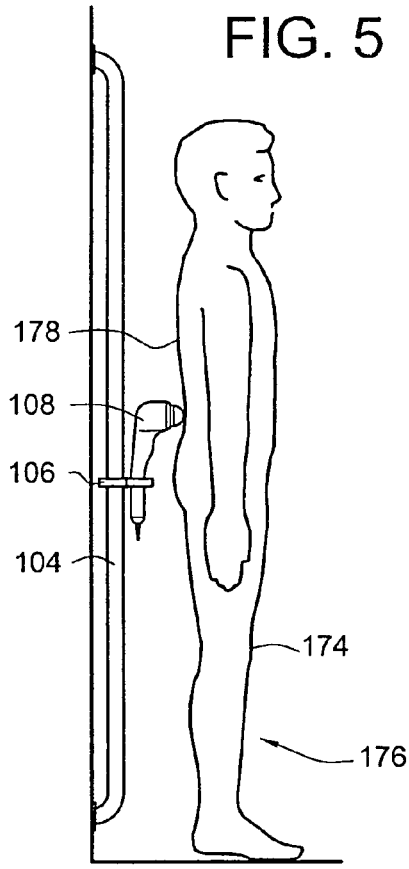
FIG. 6 is a side view of the wall mount massage assembly of FIG. 1 in use by an individual in a standing position according to a preferred embodiment of the present invention.

Reference is now made to FIG. 5 and FIG. 6 with continued reference to the above Figures. FIG. 5 is a side view of the wall mount massage assembly 102 of FIG. 1 in use by an individual 170 in a sitting position 172 according to a preferred embodiment of the present invention. FIG. 6 is a side view of the wall mount massage assembly 102 of FIG. 1 in use by a user 174 in a standing position 176 according to a preferred embodiment of the present invention. Preferably, the massage system 100 may be used in both a sitting position 172 and a standing position 176, as shown. Preferably, in a sitting position 172, a user adjusts the electrically powered percussive massager 108 (embodying herein hand holdable massaging means for electrically powered percussive massaging and further embodying herein at least one hand holdable massager structured and arranged to provide electrically powered percussive massaging) at a desired height in which the massager will be positioned on the user on the desired anatomy, preferably the back 178, as shown. The user receives self administered therapy by backing into the electrically powered percussive massager 108, as shown. Under appropriate circumstances, other arrangements may suffice. Preferably, the user utilizes a seat 180 that does not have a rear portion or sits in a chair such that the user's back 178 is towards the electrically powered percussive massager 108, as shown.

Similarly, in preferred use while standing, the user adjusts the electrically powered percussive massager 108 to a desired height above floor level allowing the electrically powered percussive massager 108 to be positioned at a preferred point on the user's anatomy, as shown. The user again receives self administered therapy by backing into the electrically powered percussive massager 108, as shown. In each case the height of electrically powered percussive massager 108 is adjusted by turning knob 146 to loosen threaded bolt 144 from center portion 118 allowing the second clamping portion 120 to swing away from the bar 104 (embodying herein wherein an inside diameter of such at least one second substantially circular aperture is adjustable) thereby releasing the second clamping portion 120 from bar 104, as shown. Holding bracket 106 is then free to travel up and down bar 104. Preferably, the holding bracket 106 (and the attached electrically powered percussive massager 108) is resecured to bar 104 by following the reverse steps of turning knob 146 to tighten bolt 144 to center portion 118 thereby securing second clamping portion 120 firmly against bar 104, as shown.

Massage system 100 is preferably adapted to allow removal and replacement of the electrically powered percussive massager 108 by operation of the first clamping portion 132 of holding bracket 106 (embodying herein wherein such rigid holding means comprises removable holding means for removably holding such hand holdable massaging means and wherein such at least one rigid holder is structured and arranged to removably hold such at least one hand holdable massager). To release the electrically powered percussive massager 108 from holding bracket 106 the user turns knob 154 to loosen threaded bolt 152 from center portion 118 allowing first clamping portion 132 to swing away from the handle 114 of the electrically powered percussive massager 108 thereby releasing the first clamping portion 132 from the electrically powered percussive massager 108. After release, the electrically powered percussive massager 108 is then free to be removed from the holding bracket 106. Preferably, the electrically powered percussive massager 108 is resecured within holding bracket 106 by following the reverse steps of inserting the handle 114 of the electrically powered percussive massager 108 into aperture 112 and turning knob 154 to tighten bolt 153 into center portion 118 thereby securing the first clamping portion 132 firmly against the handle 114, as shown (the above described arrangements embodies herein wherein an inside diameter of such at least one first substantially circular aperture is adjustable).

Figure 7:
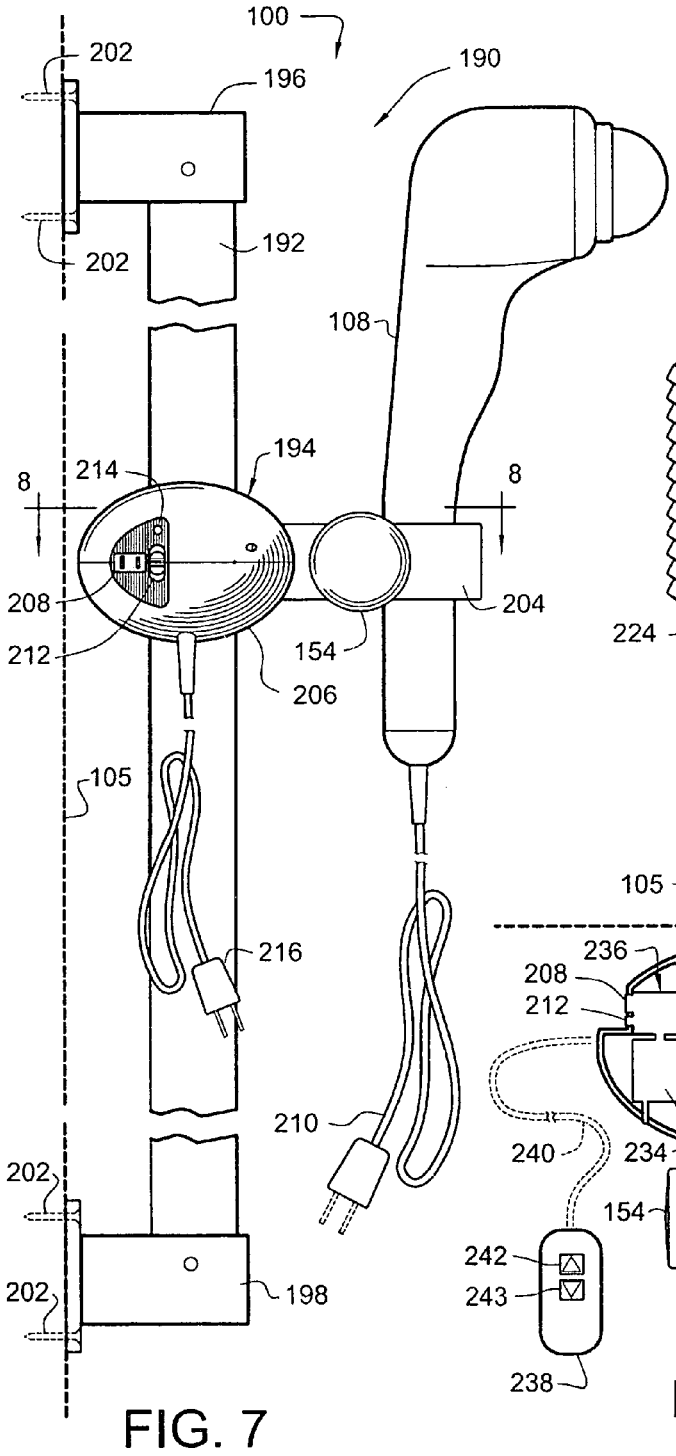
FIG. 7 is a side view, partially in section of a motorized massage assembly of the massage system according to another preferred embodiment of the present invention.

FIG. 7 is a side view, partially in section of a motorized massage assembly 190 of the massage system 100 according to another preferred embodiment of the present invention. Preferably, the motorized massage assembly 190 comprises a track bar 192, supporting a motorized holding assembly 194, and an electrically powered percussive massager 108, as shown. Preferably, track bar 192 comprises a rigid vertical member having an "I" shaped sectional profile (as further illustrated in FIG. 9). Preferably, track bar 192 has a preferred length of at least thirty six inches. In a highly preferred embodiment, a seventy two inch long bar is utilized to provide extended adjustability to massage system 100. Under appropriate circumstances, other dimensions and materials may suffice to accommodate such factors as alternate preferred ranges of adjustability and cost. Track bar 192 is preferably held in a position adjacent wall 105 (embodying herein wherein such least one mount is fixedly mounted to a vertical surface) by an upper mount 196 and a lower mount 198, as shown. Preferably, both upper mount 196 and lower mount 198 are mechanically fastened to wall 105 using appropriate fasteners 202, as shown. Preferably, upper mount 196 and/or lower mount 198 are removable from track bar 192 such that track bar 192 may be inserted through motorized holding assembly 194, as shown. Preferably, motorized holding assembly 194 comprises a holding bracket 204 similar in construction and function to the massager holding portion of holding bracket 106 as described in FIG. 1 through FIG. 3 above. Preferably, motorized holding assembly 194 comprises a rigid outer housing 206 preferably constructed from plastic such as ABS or metal such as aluminum. Although outer housing 206 is depicted in the embodiment of FIG. 7 as having an essentially elliptical shape, under appropriate circumstances a number of preferred alternate shape arrangements, sizes, and surface treatments may be used. Preferably, outer housing 206 includes a convenient power outlet 208 to allow cord 210 of electrically powered percussive massager 108 to be plugged into motorized holding assembly 194, thereby accommodating massagers having moderate cord lengths (the above arrangement embodying herein at least one electrical plug connector structured and arranged to permit plug in of at least one plug of such at least one hand holdable massager). Under appropriate circumstances outer housing 206 may include such other features as a power control switch 212, a movement control switch and/or a power indicator light 214, as shown. A power cord 216 is preferably used to connect the motorized holding assembly 194 to an external power source, as shown. Under appropriate circumstances motorized holding assembly 194 may be powered by an internal power source such as replaceable or rechargeable batteries.

Figure 8:
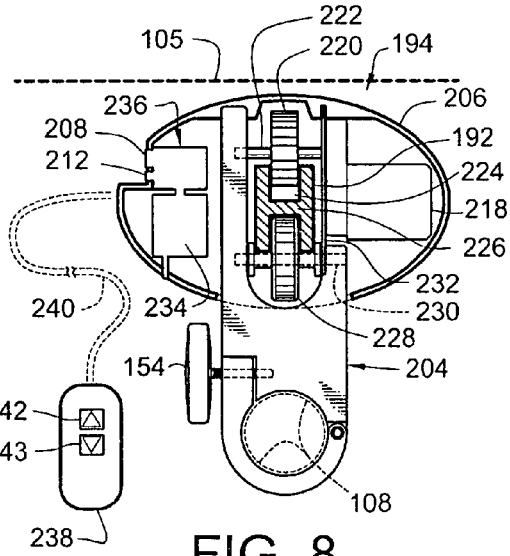
FIG. 8 is a sectional view through section 8—8 of FIG. 7.

FIG. 8 is a sectional view through section 8—8 of FIG. 7. FIG. 8 illustrates a typical arrangement of components within outer housing 206 of motorized holding assembly 194. Preferably, a high torque, low RPM motor 218, drives a pinion gear 220 attached to motor shaft 222, as shown. Pinion gear 220 preferably engages a linear rack type gear 224 positioned vertically along the length of the web 226 of track bar 192 (see FIG. 9). Rack type gear 224 preferably acts to convert the rotary motion of pinion gear 220 to a linear motion thereby propelling motorized holding assembly 194 up and down track bar 192 (embodying herein at least one electrically powered motor actuator structured and arranged to permit motorized travel along such longitudinal length). Preferably, at least one guide wheel 228 rides along the face of web 226 opposite rack type gear 224, as shown. Guide wheel 228 preferably operates on idler shaft 230, acting to stabilize the motorized holding assembly 194 on track bar 192, as shown. In light of the present teachings those skilled in the art will now appreciate that, under appropriate circumstances, other guiding and positioning arrangements may be used to provide additional stability to the system. Preferably, motor shaft 222 and idler shaft 230 are firmly positioned within outer housing 206 using an arrangement of internal support structures that may preferably include, portions of outer housing 206, secondary support structures such as plate 232 and/or portions of holding bracket 204, as shown. Motorized holding assembly 194 preferably includes a power section 236, containing power outlet 208 and controller assembly 234, as shown. In a highly preferred embodiment, a hand held remote control module 238 is used to operate motorized holding assembly 194 (embodying herein at least one control system structured and arranged to permit user-control of the motorized travel along such longitudinal length), as shown. Remote control module 238 is preferably connected to controller assembly 234 by means of a connection wire 240, as shown. Most preferably, remote control module 238 communicates with controller assembly 234 by means of a wireless RF or IR signal, as shown. In a basic embodiment, remote control module 238 is preferably equipped with an "up" button 242 and corresponding "down" button 243 to control the vertical travel of motorized holding assembly 194, as shown.

In another highly preferred embodiment of the present invention, remote control module 238 and/or controller assembly 234 preferably includes a preprogrammed or user programmable feature that allows a predetermined or memorized program to control the operation of motorized holding assembly 194 (embodying herein wherein such at least one control system is structured and arranged implement a program of user desired settings). Such a programming feature permits the user to input and recall, for example, a user specific massager position or motion pattern. Preferably a stepping motor is used in the programmable versions of motorized holding assembly 194 to allow for controlled and accurate positioning of the unit. In light of the present teachings, those skilled in the art will now appreciate that other assemblies, accessories and controls, which facilitate and enhance the operation of the above described motor driven embodiments, are within the scope of the present invention (not limited to top an bottom travel limiting switches, motor control indexing indicators, safety protection devices etc).

Figure 9:
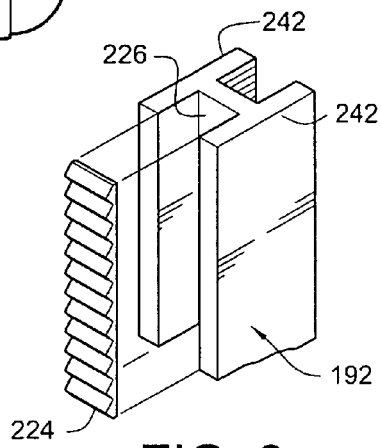
FIG. 9 is a perspective view of a bar of the motorized massage assembly of FIG. 7 according to a preferred embodiment of the present invention.

FIG. 9 is a perspective view of the track bar 192 (embodying herein adjustable longitudinal setting means, comprising a rigid bar having a longitudinal length, for setting a user selected position, along such longitudinal length, for such hand holdable massaging means and further embodying at least one adjustable longitudinal position setter, comprising at least one rigid bar having a longitudinal length, structured and arranged to set at least one user selected position along such longitudinal length for such at least one hand holdable massager) of the motorized massage assembly 194 of FIG. 7 according to a preferred embodiment of the present invention. Preferably, track bar 192 consists of an "I" shaped member comprising a center web 226 and two perpendicularly oriented flange portions 242, as shown. Preferably, rack type gear 224 is positioned adjacent to center web 226, between flange portions 242, as shown. Although it is preferred that rack type gear 224 is mechanically fastened to track bar 192 by mechanical fasteners or welding, under appropriate circumstances, rack type gear 224 may be integrally formed with track bar 192. Preferably, track bar 192 is constructed from metal, preferably extruded aluminum. Under appropriate circumstances, to address such issues as durability and cost, track bar 192 may be formed from other rigid materials such as stainless steel, plastic or a combination of metallic and plastic components.

Figure 10:
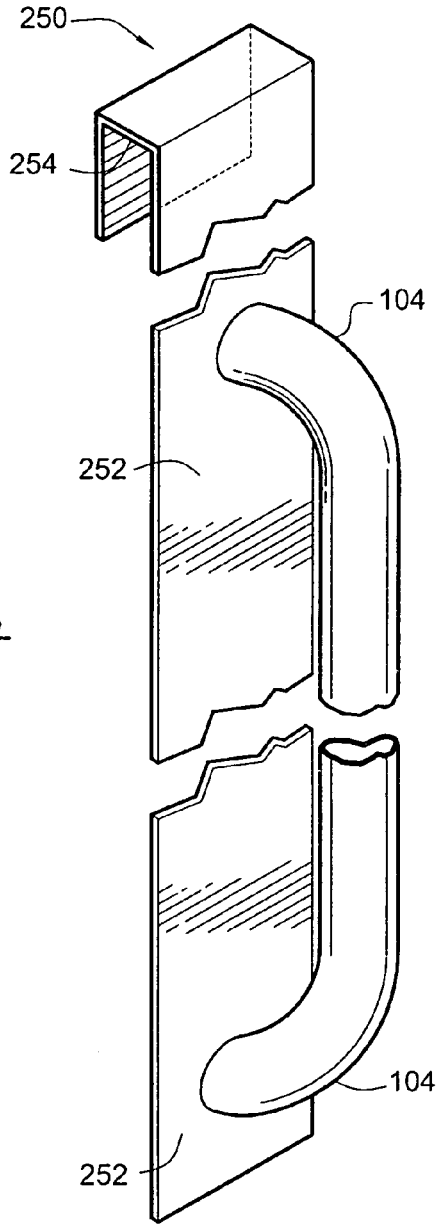
FIG. 10 is a perspective view of a door mount assembly of the massage system according to a preferred embodiment of the present invention.

FIG. 10 is a perspective view of a door mount assembly 250 of the massage system 100 according to a preferred embodiment of the present invention (embodying herein doortop mounting means for mounting such rigid holding means hung from a doortop and further embodying herein at least one doortop mount structured and arranged to mount such at least one rigid holder hung from at least one doortop). In applications of massage system 100 where it is less preferable to install a permanent wall mounted bar 104, or where portability of the system is desired, door-mount assembly 250 may be utilized. Preferably, door mount assembly 250 comprises a bar 104 mounted to a support plate 252, as shown. Support plate 252 preferably comprises a top hook 254 adapted to fit over the top of a door thereby supporting the door mount assembly 250 in a position for use. Preferably, the top hook is adapted to accommodate a standard door having a thickness of about 1-½". Under appropriate circumstances, a top hook insert may be provided to allow door mount assembly 250 to betterfit thinner (1-⅜") interior doors. Preferably, door mount assembly 250 is constructed from a rigid material, preferably metal. Under appropriate circumstances, door-mount assembly 250 may be constructed from plastic or a combination of plastic and metallic components. Under appropriate circumstances, door mount assembly 250 may preferably include sound and vibration attenuating materials to limit vibration and sound resonance within the supporting door during use. Preferably, support plate 252 is about 4" to 6" in width with a length permitting door mount assembly 250 to be hung from a 7'-0" high door while maintaining bar 104 in a position allowing use of massage system 100 in a standing or sitting position.

Under appropriate circumstances, other configurations may suffice, for example to produce a smaller, highly portable, upper-body massage unit. It should be noted that the door mount assembly 250 may be used with a manually operated holding bracket 106 or a motorized holding assembly 194.

Although massage system 100 may be distributed and installed by the manufacturer, massage system 100 is preferably supplied as a consumer kit. A consumer kit for utilizing a user supplied electrically powered, hand holdable massager 108 preferably comprises; a surface mountable bar 104, a holding bracket 106 and a set of printed instructions (indicating massagers sized and arranged to be compatible with holding bracket 106 and instructions for assembly of the kit). An alternate preferred consumer kit combination for utilizing a user supplied electrically powered, hand holdable massager 108 preferably comprises; a track bar 192, a motorized holding assembly 194 and a set of printed instructions (indicating massagers sized and arranged to be compatible with holding bracket 106 and instructions for assembly of the kit).

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A massage system comprising:

a hand-held massage unit including a housing having a handle and a head that is enlarged relative to the handle, the hand-held massage unit also including an electrically powered, percussive massager mechanism located at the head of the housing, the handle of the hand-held massage unit projecting outwardly from the head and including a length that extends from a first end to a second end of the handle, the head of the housing being located at the first end of the handle, and the hand-held massage unit also including an electric cord connected to the second end of the handle;

an elongated bar; and a bracket for connecting the hand-held massage unit to the elongated bar, the bracket including a first end that connects to the handle of the hand-held massage unit and a second end that connects to the elongated bar, the bracket being moveable up and down a length of the elongated bar to adjust an elevation of the hand-held massage unit, the bracket including a central member that extends generally between the first and second ends of the bracket, the bracket also including a first clamping arm located at the first end of the bracket and pivotally connected to the central member, the bracket further including a second clamping arm located adjacent the second end of the bracket and pivotally connected to the central member, wherein the first clamping arm is adapted for clamping the handle of the hand-held massage unit and the second clamping arm is adapted for clamping the elongated bar.

2. The massage system of claim 1, wherein the length of the elongated bar is at least 36 inches.

3. The massage system of claim 1, wherein the length of the handle of the hand-held massage unit is generally parallel to the length of the elongated bar when the hand-held massage unit is mounted to the elongated bar by the bracket.

4. The massage system of claim 1, further comprising mounting flanges and fasteners for mounting the elongated bar to a wall.

5. The massage system of claim 1, wherein the first end of the bracket is detachable from the hand-held massage unit.

6. The massage system of claim 1, wherein the central member defines a first concave surface that cooperates with the first clamping arm to define a first generally circular opening for receiving the handle of the hand-held massage unit.

7. The massage system of claim 6, wherein the central member defines a second concave surface that cooperates with the second clamping arm to define a second generally circular opening for receiving the elongated bar.

8. The massage system of claim 7, further comprising a first bolt for tightening and loosening the first clamping arm and a second bolt for tightening and loosening the second clamping arm.

9. The massage system of claim 8, wherein the first and second bolts respectively include first and second knobs for allowing the first and second bolts to be tightened and loosened by hand.

10. The massage system of claim 9, wherein the central member includes first and second sides that are oppositely positioned from one another and that extend generally between the first end second ends of the bracket, and wherein the first knob is positioned at the first side of the central member and the second knob is positioned at the second side of the central member.

11. The massage system of claim 10, wherein the first clamping arm includes a first end pivotally connected to the central member and a second end that is fastened to the central member by the first bolt, wherein the second clamping arm includes a first end pivotally connected to the central member and a second end that is fastened to the central member by the second bolt, wherein the first side of the central member defines a first notch for receiving the second end of the first clamping arm, and wherein the second side of the central member defines a second notch for receiving the second end of the second clamping arm.

12. The massage system of claim 11, wherein the first and second clamping arms have pivot axes that are parallel to one another.

* * * * *